US008602902B2

(12) United States Patent
Ochi

(10) Patent No.: US 8,602,902 B2
(45) Date of Patent: Dec. 10, 2013

(54) ROTATING AMUSEMENT DEVICE

(75) Inventor: Yasushi Ochi, Kaizuka (JP)

(73) Assignee: BLD Oriental Co., Ltd., Izumisano Osaka Prefecture (JP)

( * ) Notice: Subject to any disclaimer, the term of this patent is extended or adjusted under 35 U.S.C. 154(b) by 0 days.

(21) Appl. No.: 13/703,733

(22) PCT Filed: Apr. 25, 2011

(86) PCT No.: PCT/JP2011/002405

§ 371 (c)(1),
(2), (4) Date: Dec. 12, 2012

(87) PCT Pub. No.: WO2011/158423

PCT Pub. Date: Dec. 22, 2011

(65) Prior Publication Data

US 2013/0090176 A1 Apr. 11, 2013

(30) Foreign Application Priority Data

Jun. 15, 2010 (JP) ..... 2010-136307

(51) Int. Cl.
*A63G 1/08* (2006.01)
*A63G 23/00* (2006.01)

(52) U.S. Cl.
USPC ..... 472/40; 472/134

(58) Field of Classification Search
USPC ..... 472/28, 40, 48, 67, 68, 134, 136
See application file for complete search history.

(56) References Cited

U.S. PATENT DOCUMENTS

| | | | | |
|---|---|---|---|---|
| 2,540,013 | A * | 1/1951 | Skreberg | 472/40 |
| 6,511,382 | B1 * | 1/2003 | Ochi | 472/134 |
| 7,311,610 | B2 * | 12/2007 | Ochi | 472/134 |
| 2009/0211168 | A1 | 8/2009 | Bogar | |

FOREIGN PATENT DOCUMENTS

| | | | |
|---|---|---|---|
| JP | H1085459 | A | 4/1998 |
| JP | 2000204795 | A | 7/2000 |
| JP | 2001137557 | A | 5/2001 |
| JP | 2001137558 | A | 5/2001 |
| WO | 9959690 | A1 | 11/1999 |
| WO | 2007026476 | A1 | 3/2007 |
| WO | 2008032687 | A1 | 3/2008 |

OTHER PUBLICATIONS

International Search Report; Application No. PCT/JP2011/002405; Jun. 7, 2011; Japanese Patent Office.

* cited by examiner

*Primary Examiner* — Kien Nguyen
(74) *Attorney, Agent, or Firm* — Stevens & Showalter LLP

(57) ABSTRACT

Disclosed is an amusement device capable of increased sustainment of user interest. The present disclosure presumes a rotating amusement device comprising an amusement device proper and a rotating base. The amusement device proper further comprises a playroom, an airtight member, and a ventilator means. The playroom is a region surrounded by partition members that partition an amusement region, and the airtight member is disposed below the partition members that configure the wall units of the playroom.
The interior of the playroom further comprises a ventilator means for creating a convection current in the air inside the playroom, and a plurality of balloons that are positioned in the playroom are made to float about wildly by the ventilator means.

8 Claims, 7 Drawing Sheets

ROTATING AMUSEMENT DEVICE

TECHNICAL FIELD

This invention relates to a rotating amusement device, it particularly relates to a rotating amusement device wherein balloons floats wildly and a plurality of users can play with together.

BACKGROUND ART

Currently, a rotary playground equipment premising that a few users (mean children) play together has been developed.

For example, the sandbox where a plurality of users plays with is disclosed in Japanese Unexamined Pat. App. Pub. No. H10-85459, and an air dome used in events is disclosed in Japanese Unexamined Pat. App. Pub. No. 2000-204795.

Other than above technique, generally, the playground equipment which is developed for playing with for a plurality of users, is common in amusement grounds or a theme park.

SUMMARY OF THE INVENTION

Problem Invention is to Solve

The child expected as a user of the present invention have their interest to a moving thing very much, so if the sandbox and air dome are rotated, it can make the further more interest of users.

However, there was not an idea that the conventional playground equipment can turn.

For playing with a plurality of user together, supporting and rotating the weighting of the whole playground equipment including the user requires another mechanism. The construction of the playground equipment is complicated.

The playground equipment of complicated mechanism can break down many times. Taking trouble of the maintenance into account, it was the common general technical knowledge of the maker producing the playground equipment that it avoids turning the playground equipment having the construction that a plurality of users as described above plays with together (mean a user runs around and jumps).

However, as described above, the children has interests for the moving things very much. To make the continual interest of the child, there were many requests for the guardians hoping to rotate the playground equipment. An object of the present invention provides a rotating amusement device having a loads resistance by simple construction, in the amusement device that a plurality of user plays with together.

Means for Resolving the Problem

This Invention to achieve the problem is a rotating amusement device having an amusement device main body and a rotating base. The amusement device main body further comprises a playroom, an airtight member, and a ventilator means. The playroom is a region surrounded by partition members that partition an amusement region, and the airtight member is disposed below the partition members that configure the wall units of the playroom. A ventilator means is provided in the playroom, for creating a convection current in the air inside the playroom. A plurality of balloon placed in the playroom floats about wildly by the ventilator means. By above configuration, the medium-sized playground equipment facilities that a plurality of user can play with at the same time, is able to rotate.

In accordance with an aspect of the present invention, it is preferable the rotating base is configured to stack a lower part base substance and an upper part rotating body while aligning their central axes. And, the lower part base substance comprises a bottom substrate, a drive motor placed on the bottom substrate, and a caster. The drive motor is the motor which can rotationally drive the upper part rotating body, the caster is for supporting the upper part rotating body, and is provided to the place which the upper part rotating body can rotate around the central axe. It is desirable the caster is provided on predetermined circumference on the lower part base substance.

As follows, the rotating base is configured to stack a lower part base substance and an upper part rotating body while aligning their central axes, and it can be configured making eccentric rotation from a central axe. That is, the lower part base substance comprises a bottom substrate, a drive motor placed on the bottom substrate, and a caster. The drive motor is the motor which can rotationally drive the upper part rotating body, the crank is pivotally supported by the rotation axis rotated by the drive motor. And, the caster is for supporting the upper part rotating body, and is provided to the place which the upper part rotating body can rotate around the central axe. Therefore, the amusement device main body makes eccentric rotation together with the rotating base. It is desirable the caster is provided on predetermined circumference on the lower part base substance.

The caster vertically supports the load by supporting the load of the amusement device main body. Therefore, the play facilities plurality of user plays with at the same time are able to be turned.

In accordance with an aspect of the present invention (including configuration pivotally supporting the crank), it is desirable that the caster is placed on the bottom substrate, in the state a wheel of the caster upturned, and that the upper part rotating body is supported with the wheel of the caster. The rotating base having smooth rotation can be configured by upturning and placing the wheel of the caster.

In accordance with an aspect of the present invention, a gripping member may be hung from the upper part of the playroom configuring the amusement device main body, and is for being gripped by a user. Further it is desirable that a slip ring for supplying electric power to the rotating amusement device is provided. Even if the rotating amusement device rotates, electric power can be supplied to the illuminations member such as the LED which provided to a rotary playground equipment Furthermore, a torque limiter may be mounted in the rotation axis of the drive motor, for controlling a driving torque of the rotation axis within predetermined value.

The amusement device main body may be placed on the rotating base, in the sloping state. By placing the amusement device main body to the rotating base, in the state sloping, a complicated rotation is able to be caused by simple configuration. Effects of the Invention This Invention is a rotating amusement device having an amusement device main body and a rotating base. Amusement device main body comprises a playroom, an airtight member and a ventilator means. The playroom is a region surrounded by partition members that partition an amusement region, and the airtight member is disposed below the partition members that configure the wall units of the playroom. And a ventilator means is provided in the playroom, for creating a convection current in the air inside the playroom, and a plurality of balloon placed in the playroom floats about wildly by ventilator means. By above configuration, the whole playroom rotates while a balloon in the playroom floats about wildly. Therefore, the amusement device capable of increased sustainment of user interest can be provided.

DESCRIPTION OF THE PREFERRED EMBODIMENT

Detailed Description of the Preferred Embodiment 1

Amusement Device Main Body

Figure 1:
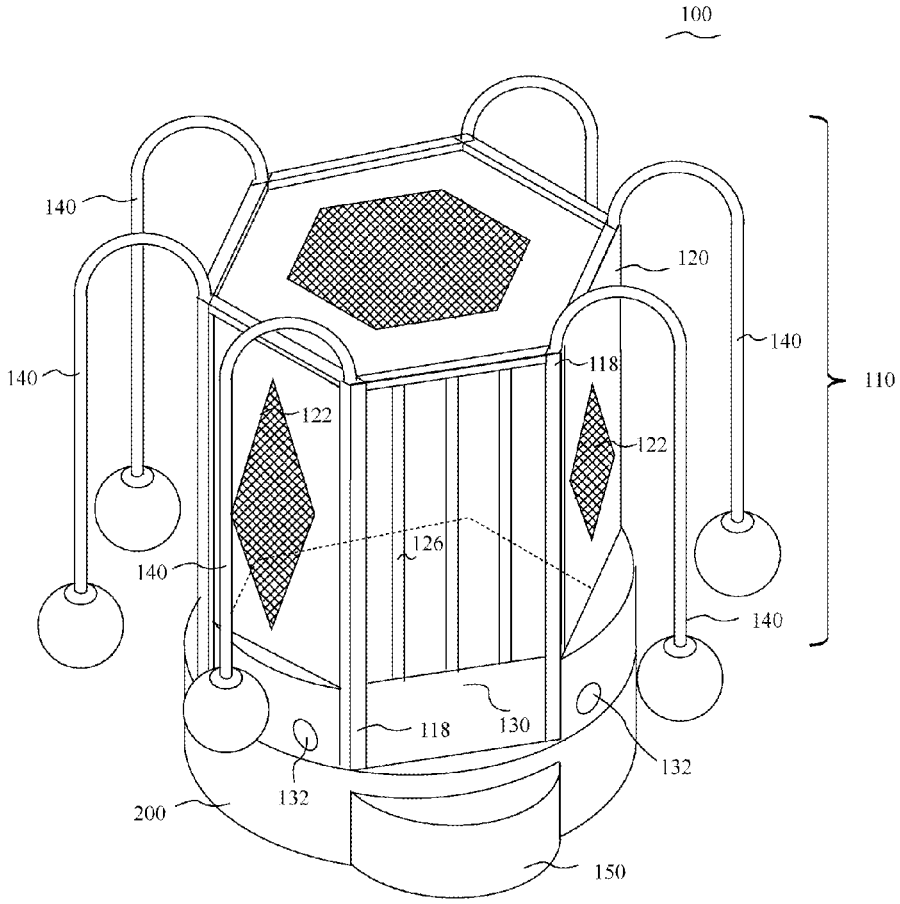
FIG. 1 is a perspective view illustrating an outlined configuration of a rotating amusement device in accordance with an embodiment of the present invention.
Figure 2:
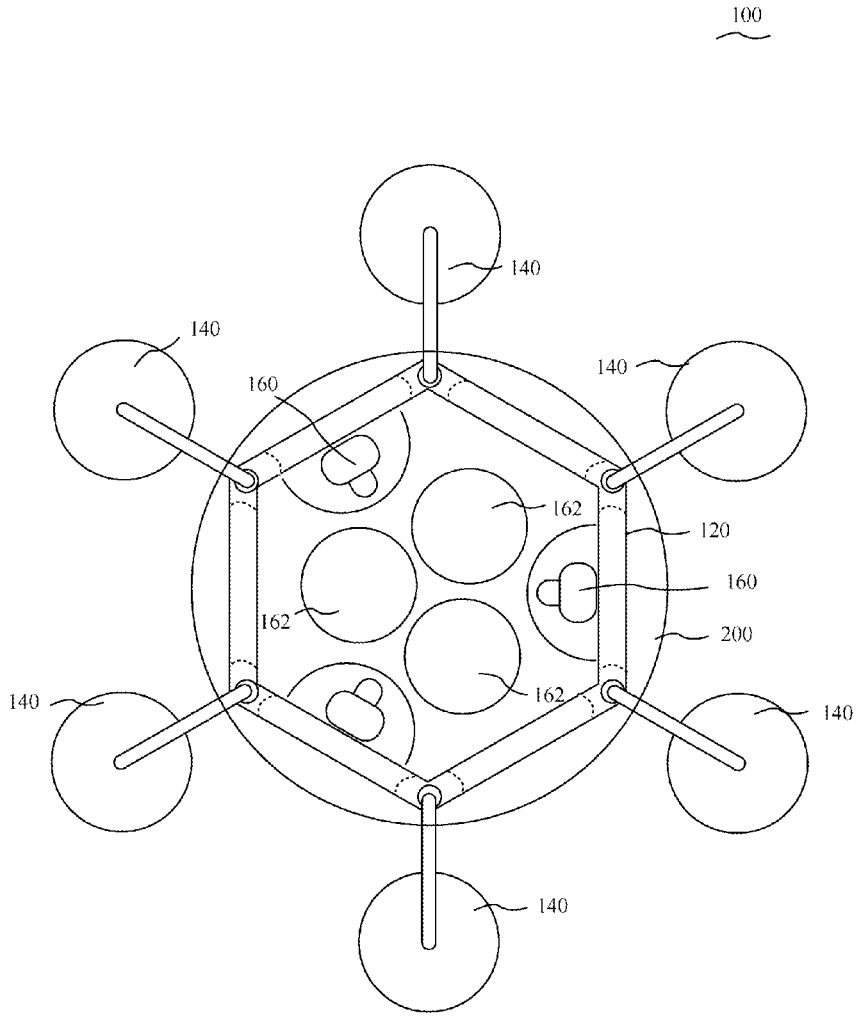
FIG. 2 is a top view illustrating an outlined configuration of a rotating amusement device in accordance with an embodiment of the present invention.
Figure 3:
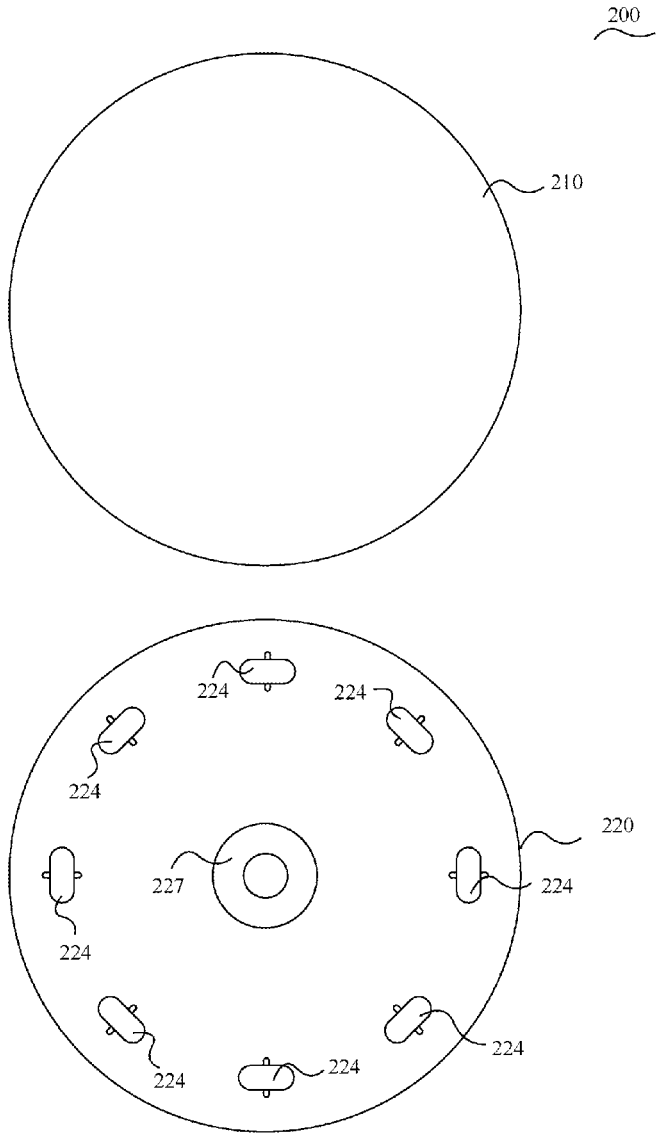
FIG. 3 is a top view illustrating an outlined configuration of a rotating base comprised to the rotating amusement device in accordance with an embodiment of this Invention.
Figure 4:
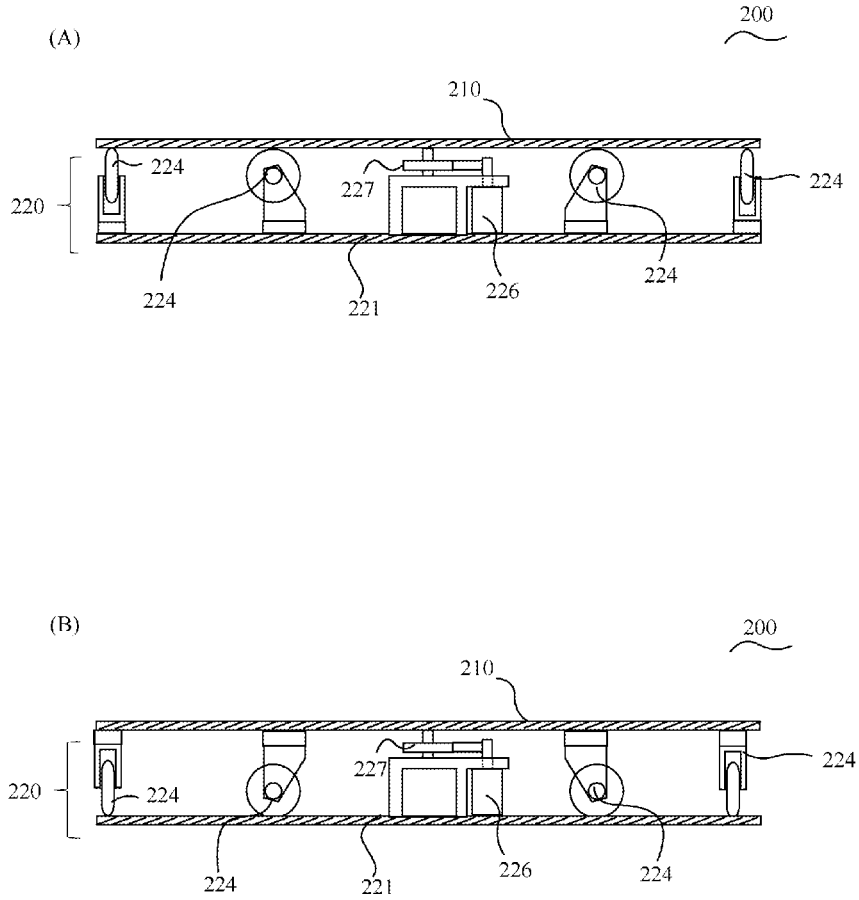
FIG. 4 is a side view illustrating an outlined configuration of a rotating base comprised to the rotating amusement device in accordance with an embodiment of this Invention.

A specified embodiment of a rotating amusement device 100 is explained hereinafter with reference to the accompanying drawings. FIG. 1 is an outline schematic view showing the whole configuration of a rotating amusement device 100 of this Invention. FIG. 2 is a outline schematic view showing the whole configuration of a rotating amusement device 100 of the present invention from the upper part. Furthermore, FIG. 3 to FIG. 7 are schematic views showing a rotating base 200 provided to rotating amusement device 100 of this Invention or showing a rotating amusement device 100 comprising the rotating base 200. However, the details of the all parts which do not directly-relate to the present invention will be omitted. The description of a rotating base 200 described in FIG. 6 from FIG. 4 is described below.

That is to say, as illustrated in FIG. 1, a rotating amusement device 100 of this Invention comprises an amusement device main body 110 and a rotating base 200. The amusement device main body 110 comprises a playroom having a plurality of blowers 160. In the present embodiment, an amusement device main body 110 of the form of top view hexagon shown in FIG. 2 is formed, as follows. In the following, a room user (mean infant) plays with is referred to as a playroom.

At first, a strut. 118 is stood in the position to form a hexagon on after-mentioned rotating base 200. The playroom frame 120 is formed by coupling the upper end of neighboring struts 118, among each the struts 118. Alternatively, a planar hexagon-formed frame is formed beforehand, the playroom frame 120 is formed by connecting between the upper end of each strut 118 and the neighborhood of top-most vertices of one of the hexagon-formed frame.

A sheet 122 formed of translucency material as a wall surface of the playroom, is placed on the playroom frame 120 formed as above. At this time, a sheet 122 formed of translucent material is placed on the six surfaces by adding the top and the 5 side faces (except an entrance), to the playroom frame 120 from top-view hexagon A predetermined air hole is formed on a wall surface formed with the sheet 122 of the translucent material. As for the rotating amusement device 100 in this Invention, a lot of balloons 162 (mean the balloon that air is filled, hereinafter the same shall apply) are placed in the playroom, and the balloons 162 flow. Therefore, air hole is required in order to make air circulate. In the present embodiment, rhombus air hole 124 is formed. Air hole 124 imitating the shape such as character may be formed so that a child likes. As shown in FIG. 1, in the present embodiment, a mesh is provided over the air hole 124.

An entrance member is provided to the place formed as the entrance. For example, in the present embodiment, a plurality of strings 126 as the entrance member is hung from the upper end of the entrance. The user enter the amusement device main body 110 by opening the strings 126 from side to side As other entrance member, a curtain formed of a translucent member may be hung from the upper end of the entrance. The member which included sheet 122 of the translucent material and the entrance member correspondings to the partition members of this Invention. Furthermore, the room surrounded by the partition members provided in the playroom frame correspondings to the playroom of this Invention, a region in the playroom correspondings to an amusement region of this Invention.

An air flow wall for circulating the air flow produced by after-mentioned ventilator means is provided to the wall surface and entrance formed as above. In the present embodiment, a wall formed of airtight member 130 is comprised on the wall surface and in the lower part of the entrance. Also, the sheet of the airtight material may be placed on the wall surface and the lower part of the entrance. By the air flow wall comprised in the lower part of the playroom, the air flow accrued by after-mentioned ventilator means collides against the air flow wall and causes rising air. A step 150 may be provided on the entrance. It is desirable for all the lateral face of the playroom to be covered with the airtight member 130 in order to enough stirring the balloon 162 Therefore, the step 150 allows for users to step over the airtight member 130 provided to the entrance and to go in and out with is stepped over and becomes able to go in and out.

A ventilator means is provided in the playroom which the wall surface and the entrance are formed as described above. As shown in FIG. 2, in accordance with exemplary embodiments, a blower 160 as ventilator means is placed on the lower part of the playroom. Each blower 160 is placed to the place which air sent from the blower 160 collides with For example, as shown in FIG. 2, when the amusement device main body 110 is seen from top, the blowers 160 can be placed so that each blower 160 does not be placed side by side. Alternatively, each blower 160 can be placed so that a pair of blower 160 faces each other. The whole of each blower 160 is covered with the state the air outlet opened. For example, the whole blower 160 may be coated by elastic member such as urethane. Furthermore, the suction port portion is opened so that it can blow air from suction port of the blower 160. In the present embodiment, air is blown to the suction port of the blower 160 via aperture 132 formed to the outside lower portion of the amusement device main body 110.

A gripping member 140 for making users capable of holding is provided to the amusement device main body 110 formed as above. In the present embodiment, a ball as the gripping member 140 is hung from the upper part of the playroom. For example, one end of a bent member is rotatably placed near the top-most vertices of the upper part of the playroom, the ball is hung from the other end of the bent member by a hanging member Rotating Base Then, a rotating base 200 provided to the rotating amusement device 100 of this Invention is described with reference to the drawings. FIG. 3 to FIG. 7 are an outline schematic view showing the whole configuration of a rotating base 200. However, the details of the all parts which do not directly-relate to the present invention will be omitted. A rotating base 200 comprises an upper part rotating body 210 and a lower part base substance 220. As shown in FIG. 3 (A), the upper part rotating body 210 is circle-shaped substrate, however, it may be rectangle shape and polygon, if trouble-free against rotation.

As shown in FIG. 3 (B) and FIG. 4, the lower part base substance 220 comprises a center gear 227, a drive motor 226 for driving the center gear 227 and a caster 224. At first, the center gear 227 is placed on the center location when the bottom substrate 221 (a circular shape is used with this invention, however any shape may be used) of the lower part base substance 220 is seen from a top. Of course, both are placed so that an axis of revolution of center gear 227 is placed corresponding to the central axe of the bottom substrate 221. And, the drive motor 226 is placed on the place capable of rotationally driving the center gear 227. A roller chain is wound up to center gear 227 and a rotation axis of the drive motor 226 so that the center gear 227 can rotate by the drive motor 226, so when rotation axis of the drive motor 226 rotates, it may be configured so that center gear 227 rotates via the roller chain.

Furthermore, plurality of caster 224 is placed to the lower part base substance 220, in plane with the center gear 227 and the drive motor 226. The caster 224 is placed on the lower part base substance, with a wheel portion of the caster 224 as the top. As for plurality of caster 224, the facing casters 224 are placed in symmetry position regarding the center of the lower part base substance 220, and adjacent casters 224 are placed equally-spaced. In the present embodiment, the wheel portion of caster 224 face up is employed. The caster 224 does not go through wiring in rotating base 200 by upturning the wheel of caster 224. Of course as shown in FIG. 3 (A) or FIG. 3 (B), the wheel portion of the caster may be upturned, and the wheel part of downturn may be placed.

As described below, when the upper part rotating body 210 and lower part base substance 220 is combined, the rail (not shown) of the annular shape may be placed on the place that the caster 224 makes a contact with to the upper part rotating body 210. The caster 224 rotates while making a contact with the rail, so the upper rotation body 210 rotates depending on rotation of the casters 224. Therefore, in this present invention, a wheel of each caster 224 of the lower part base substance 220 supports the upper part rotating body 210. A wheel portion of the caster of downturn may be used as described above.

Figure 5:
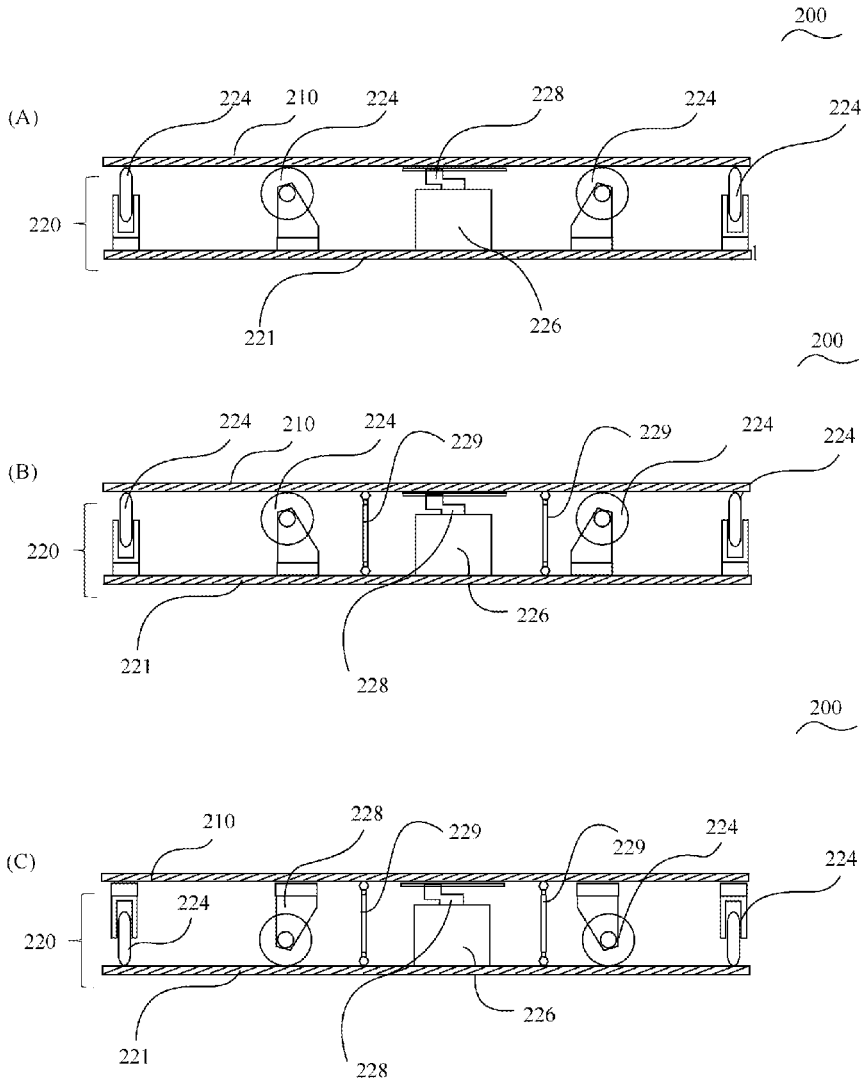
FIG. 5 is a side view illustrating an outlined configuration of an rotating amusement device in accordance with an embodiment of the present invention.

Next, the upper part rotating body 210 and lower part base substance 220 is combined. At first, while upturning the surface where the casters 224, the center gear 227, and the drive motor 226 are placed, the lower part base substance 220 is placed on the floor. And, the upper part rotating body 210 is stacked on the lower part base substance 220 so that the center of the bottom substrate 221 coincides with the center of the upper part rotating body 210. At this time, the upper part rotating body 210 fits or fixes the center gear 227 so that the upper part, rotating body 210 rotates when the center gear 227 of the lower part base substance 220 rotates, thus the rotating amusement device 100 of this Invention is configured. For maintenance, it is desirable that the center gear 227 is engaged removable to the upper rotation body 210. If the amusement device main body 110 can be placed, any shape is preferable of the upper part rotating body, any shape of substrate such as rectangular shape, polygon, circle or the like, can be attached. FIG. 5 shows the rotating amusement device 100 placing the playroom on the rotating base 200.

Number of revolutions of drive motor 226 may be controlled by a control unit not shown in the figure. A control unit stores the most suitable number of revolutions beforehand, and the drive motor 226 is rotationally driven based on the number of revolutions. A switch (not shown) for operating the drive motor 226 is provided to the rotating base 200, and a rotating speed of the drive motor 226 may be configured to be controllable by the switch.

Detailed Description of the Preferred Embodiment 2

Figure 6:
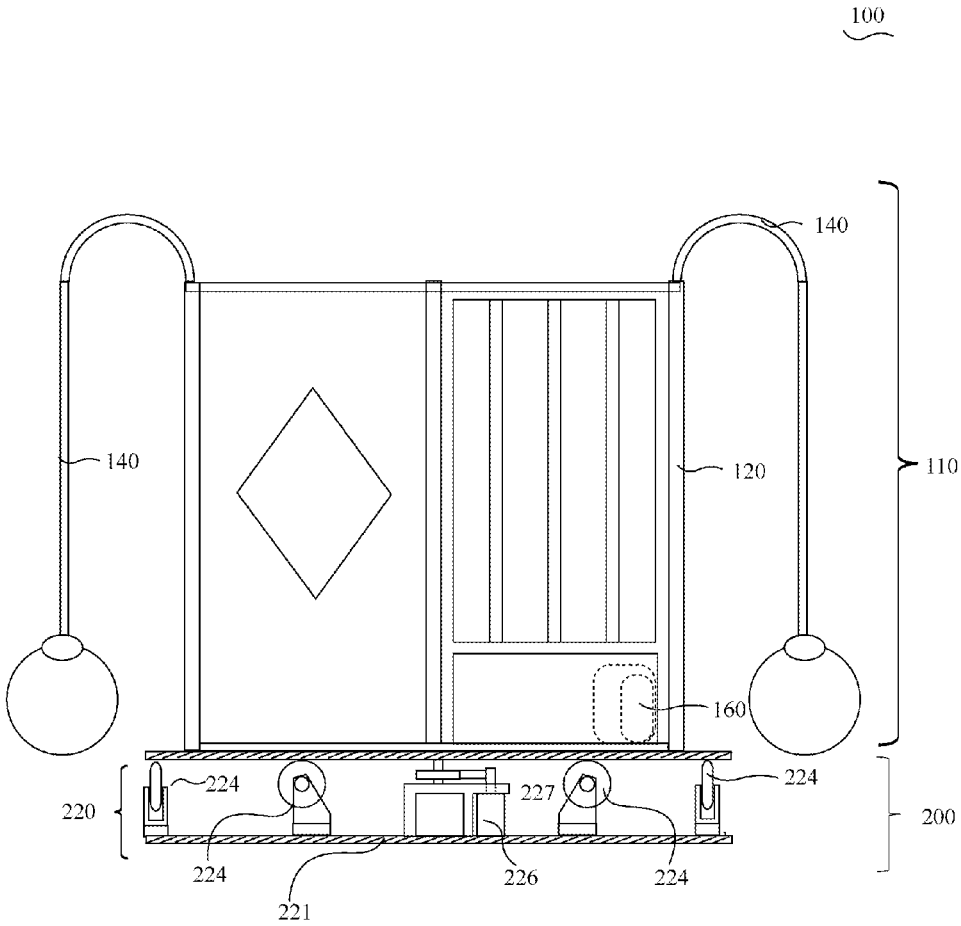
FIG. 6 is a side view illustrating an outlined configuration of a rotating base comprised to the rotating amusement device in accordance with an embodiment of this Invention.

By the rotating base 200 used for preferred embodiment 1 configured as follows, the rotating amusement device 100 that makes eccentric rotation can be configured. Regarding other than after-mentioned eccentric shaft, it is same as the rotating amusement device 100 described with detailed description of the preferred embodiment 1. Therefore, regarding the configuration except the eccentric shaft, drawing and illustration is omitted As shown in FIG. 6 (A), FIG. 6 (B), FIG. 6 (C), after-mentioned eccentric shaft is used for the rotation axis of the drive motor 226. That is, as shown in FIG. 6, by providing an eccentric shaft (e.g., crank 228) comprising a handle for extending the shaft apart from the rotation axis of drive motor 226, the rotating shaft of the drive motor is displaced within a specified range.

That is to say, one end of the crank 228 rotates on a same axis as the rotation axis of the drive motor 226, the other end of the crank 228 makes eccentric rotation around the rotation axis (mean that it rotates around the position apart from the rotation axis) Of course, a switch (not shown) for operating a drive motor 226 is provided to the rotating base 200. A rotating speed of the drive motor 226 may be configured to be controllable by the switch. Of course, the rotating base 200 shown in FIG. 6, is provided with the upper part rotating body 210 and the lower part base substance 220. And, the upper part rotating body 210 is a circle-shaped substrate, the lower part base substance 220 comprises a center gear 227, a drive motor 226 for driving the center gear 227 and a caster 224, each caster 224 supports the upper part rotating body 210.

A regulation means 229 for regulating the auto-rotation of the upper part rotating body 210 can be provided. An elastic body (a rubber or a spring are preferably used) connecting between bottom substrate 221 for placing the drive motor 226, and the upper part rotating body 210 is used as the regulation means 229. If the regulation means 140 can be configured to regulate auto-rotation of upper part rotating body 210, any alignment method thereof is preferable. In accordance with exemplary embodiments, as shown in FIGS. 6 (B) and (C). The regulation means 229 is placed from vicinity of the drive motor 226 placed to the bottom substrate 221 to under surface of the upper part rotating body 210. The regulation means 229 may be placed in vertical direction from the bottom substrate 221 and may be placed at an angle from bottom substrate 221. The autorotation of the upper part rotating body 210 is regulated by the regulation means 229, therefore the upper part rotating body 210 rotates around the rotation axis of the drive motor 226 while swinging.

Others

Figure 7:
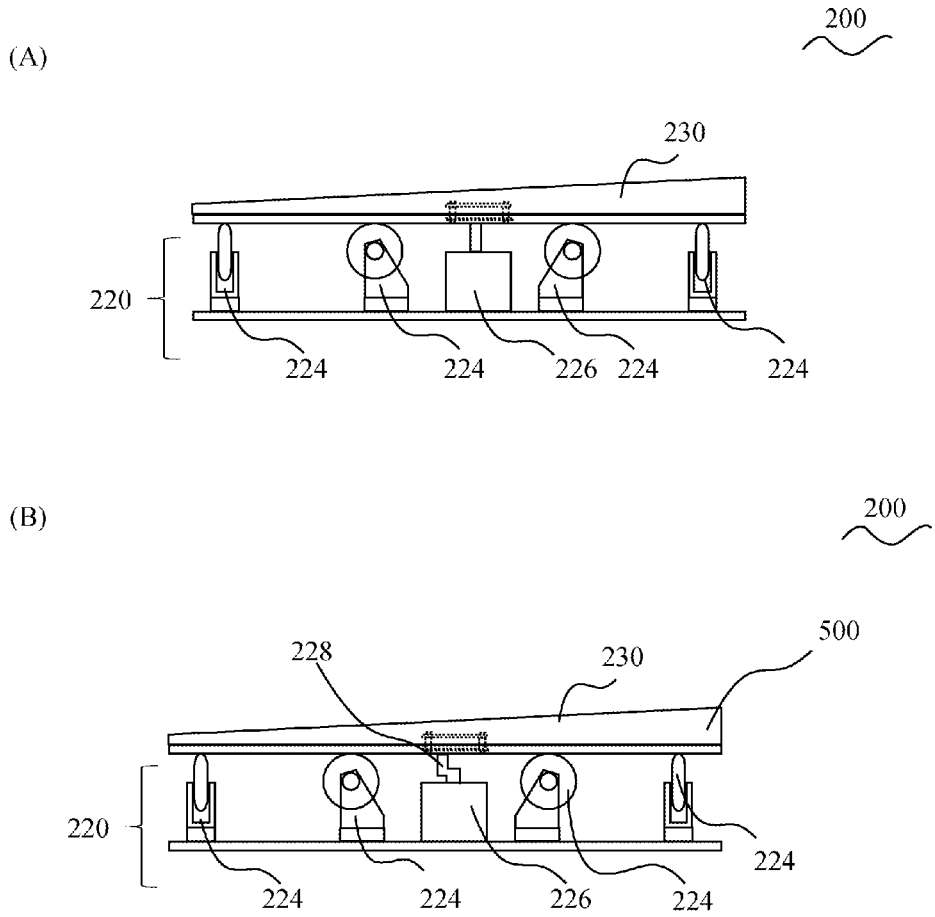
FIG. 7 is a side view illustrating an outlined configuration of a rotating base comprised to the rotating amusement device in accordance with an embodiment of this Invention.

In the preferred embodiment 2, the upper part rotating body 210 is horizontally attached to one end of the crank 228 (the other end is attached to rotating shaft of the drive motor 226). On the other hand, amusement device main body can be attached with inclined state. In FIG. 7, a sloping plate 230 is provided to the upper part rotating body 210, the amusement device main body 110 is placed on the upper part rotating body 210 with sloping state. In this case, the rotation axis of drive motor 226 used with detailed description of the preferred embodiment 1 may be used (cf. FIG. 7 (A)), the crank 228 used with detailed description of the preferred embodiment 2 may be used (cf. FIG. 7 (B)). Regarding other than configuration to attach the amusement device main body at an angle, it is the same as detailed description of the preferred embodiment 1 and 2, so Illustration and illustration are omitted.

An overcurrent protection means (for example torque limiter) for protecting the overcurrent of the drive motor 226 provided to the rotating base 200 (hereinafter explaining include whether or not the crank 228 is provided) may be attached to the rotation axis or crank 228 of the drive motor 226. As mentioned above, the amusement device main body 110 is placed on the upper part of the drive motor 226, thus weight for users playing hangs to the drive motor 226. If the loads added to the drive motor 226 is greater than the predetermined value, the overcurrent protection means detects the load, and idles the drive motor 226.

That is to say, a torque limiter for protecting the drive motor 226 from a surplus torque and a torque sensor for detecting running torque are provided between output shaft (mean rotating shaft) of the drive motor 226 and the center gear 227. As the torque sensor, a contact-type torque sensor may be used, alternatively a noncontact torque sensor may be used too. If a torque detected by the torque sensor is beyond an expected limit, the rotative power from the drive motor 226 is not transmitted to the center gear 227 by the torque limiter.

Alternatively, when the electric current higher than expected limit flows in the drive motor by being overloaded, the electric current to the drive motor may be interrupted by inverter control.

Furthermore, a slip ring (not shown) is provided to the rotating amusement device 100, and electric power may be supplied to an illuminations member (e.g., a LED ribbon which the device outside is provided with) of the rotating amusement device 100 by this slip ring. By using the slip ring as power supply means, power feeding can be employed without torsion of the electric wiring, even if the rotating amusement device rotates, In this embodiment, the playroom is formed of a strut, the playroom may be formed of the following elastic units. That is, a plurality of elastic units is formed of elastic sheet, the playroom may be assembled by coupling the plurality of elastic units. At first, the elastic unit is formed as follows. For example, a given elastic sheet is welded and formed to a trunk shape, the elastic unit is formed by welding upper and lower open end by a circular elastic sheet. If air can be filled airtight therein, any process of manufacture of the elastic unit may be used.

And when the elastic unit is coupled, an opening (hereinafter called communication hole) is formed in the given parts of each elastic unit to be coupled. Both elasticity unit is coupled by communicating the formed communication holes with each other (it is only necessary an airflow path communicates). That is, an airflow path communicates in the elastic unit via the communication hole. Therefore, when air is blown to one of the elastic unit from outside, the plurality of elastic units which the airflow path communicates with can be filled with air. As a joint member of the elastic unit, an adhesive tape may be used, and plurality of elastic unit may be welded. The playroom of this Invention can be configured as an assembly of the elastic unit, by coupling the plurality of elastic units.

Further, an air inlet for sending the air from outside is provided in at least one of the elastic units, among the plurality of elastic unit. For example, an opening is formed in the given portion of one selected elastic unit, and a valve body is attached to the opening as an air inlet. Any shape and material may be used to the valve body if the air inlet can be opened and closed by predetermined manner. A plurality of playground equipment members is formed as above, the playroom of this Invention can be configured as the assembly of the plurality of playground equipment members. For example, by connecting or separating so that an airflow path does not communicate between the playground equipment members, when air is blown from a valve body provided to one playground equipment member, air does not fill other separated playground equipment members. By configuring as above, for example, even if one of the playground equipment members (mean a part of the playroom of this Invention) is damaged and air leaks, it is only necessary that the playground equipment member damaged should replace or repair, it is not necessary all playground equipment members provided to the rotating amusement device 100 are replaced or repair.

A seat elastic unit may be placed in the playroom. Furthermore, it is desirable to configure to softening compared with elastic unit configuring playroom by adjusting the air quantity filled to the seat elastic unit. The users who sat down on the seat elastic unit can stably play by softening the member (the seat elastic unit) used as a seat than the member configuring the playroom.

INDUSTRIAL APPLICABILITY

This Invention is a rotating amusement device having an amusement device main body and a rotating base. Amusement device main body comprises a playroom, an airtight member and a ventilator means. The playroom is a region surrounded by partition members that partition an amusement region, and the airtight member is disposed below the partition members that configure the wall units of the playroom. And, the interior of the playroom further comprises a ventilator means for creating a convection current in the air inside the playroom. A plurality of balloon placed in the playroom floats about wildly by ventilator means By above configuration, the whole playroom rotates while a balloon in the playroom floats about wildly, Therefore, the amusement device capable of increased sustainment of user interest can be provided, which makes them industrially useful.

What is claimed is:

1. A rotating amusement device having an amusement device main body and a rotating base, comprising:

said amusement device main body, each comprising:

a playroom surrounded by a partition members for partitioning an amusement region;

an airtight member provided below the partition members configuring a wall of the playroom, a ventilator means provided in the playroom, for creating a convection current in the air inside the playroom;

a plurality of balloons positioned in the playroom for being made to float about wildly by the ventilator means.

2. The rotating amusement device according to claim 1, wherein the rotating base is configured to stack a lower part base substance and an upper part rotating body while aligning their central axes, and said lower part base substance, comprising:

a bottom substrate;

a drive motor placed on the bottom substrate, capable of rotationally driving the upper part rotating body;

a caster placed on a position allowing the upper part rotating body to rotate around the central axe, for supporting the upper part rotating body.

3. The rotating amusement device according to claim 1, wherein the rotating base is configured to stack a lower part base substance and an upper part rotating body while aligning their central axes, and said lower part base substance, comprising:

bottom substrate;

a drive motor placed on the bottom substrate, capable of rotationally driving the upper part rotating body;

a crank pivotally supported by a rotating shaft rotated by the drive motor;

a caster placed on a position allowing the upper part rotating body to rotate around the central axe, for supporting the upper part rotating body, the amusement device main body makes eccentric rotation together with the rotating base.

4. The rotating amusement device according to claim 2, wherein the caster is placed on the bottom substrate, in the state a wheel of said caster upturned; said upper part rotating body being supported with the wheel of said caster.

5. The rotating amusement device according to claim 1, further comprising a gripping member hung from the upper part of the playroom configuring the amusement device main body, for being gripped by a user.

6. The rotating amusement device according to claim 1, further comprising a slip ring for supplying electric power to the rotating amusement device.

7. The rotating amusement device according to claim 1, further comprising a torque limiter mounted in the rotation axis of the drive motor, for controlling a driving torque of the rotation axis within predetermined value.

8. The rotating amusement device according to claim 1, said amusement device main body is placed on the rotating base, in the sloping state.

* * * * *